US005593086A

United States Patent [19]

Ho

[11] Patent Number: 5,593,086

[45] Date of Patent: Jan. 14, 1997

[54] DOCUMENT HOLDER WITH AN EXTENSIBLE-RETRACTABLE BAG

[76] Inventor: Chin-Lien Ho, No. 36, Lo-Yang Rd., Hsi-Tun Dist., Taichung City, Taiwan

[21] Appl. No.: 491,057

[22] Filed: Jun. 16, 1995

[51] Int. Cl.[6] ..... B65D 30/20

[52] U.S. Cl. ..... 229/67.3; 229/67.4; 383/121

[58] Field of Search ..... 229/67.1, 67.2, 229/67.3, 67.4, 72; 206/425; 383/121

[56] References Cited

U.S. PATENT DOCUMENTS

| | | | |
|---|---|---|---|
| 909,734 | 1/1909 | Zoerb | 229/72 |
| 1,005,403 | 10/1911 | Zoerb | 206/425 |
| 1,734,642 | 11/1929 | Olm | 229/67.4 |
| 3,493,637 | 2/1970 | Barrett et al. | 229/67.3 |
| 4,274,577 | 6/1981 | Walsh, Jr. | 229/67.3 |

*Primary Examiner*—Stephen P. Garbe
*Attorney, Agent, or Firm*—Panitch Schwarze Jacobs & Nadel, P.C.

[57] ABSTRACT

A document holder includes an open bag body which has an elongated bottom plate with first and second long sides, a vertical first side plate which extends integrally from the first long side of the bottom plate, a vertical second side plate which is mounted movably on the bottom plate, two collapsible connecting members which interconnect the first and second side plates, a plurality of sheets which are attached to the connecting members to define a plurality of holding rooms between the first and second side plates, and a vertical guideway plate which projects integrally from the second long side of the bottom plate such that the second side plate is located at a first position which is situated on the bottom plate between the guideway plate and the first side plate. A guide sheet is mounted on an inner surface of the guideway plate. A resilient pull strap pulls the guideway plate toward the first side plate. When the guideway plate is unfolded relative to the bottom plate to keep the guideway plate and the bottom plate in a plane, the second side plate can be pulled outward from the first position to a second position which is situated on the guideway plate so as to enlarge the holding rooms.

3 Claims, 6 Drawing Sheets

DOCUMENT HOLDER WITH AN EXTENSIBLE-RETRACTABLE BAG

BACKGROUND OF THE INVENTION

1. Field of the Invention

The invention relates to a document holder, more particularly to a document holder with an extensible-retractable bag.

2. Description of the Related Art

FIG. 1 is a perspective view of a conventional document holder which includes a bag body 10. As illustrated, the bag body 10 has an elongated bottom plate 111 with a first long side 111A and a second long side 111B which is parallel to the first long side 111A, a vertical first side plate 11 extending integrally from the first long side 111A of the bottom plate 111, a cover plate 12 extending integrally from an upper end portion of the first side plate 11 to cover an open top of the bag body 10, a vertical second side plate 16 mounted on the bottom plate 111 and spaced apart from the first side plate 11, a pair of collapsible connecting members 13 mounted over the bottom plate 11 and interconnecting the first and second side plates 11, 16 in such a manner that the second side plate 16 is generally parallel to the first side plate 11 and that a document receiving space is defined between the first and second side plates 11, 16 and between the connecting members 13, and a plurality of partition sheets 15 attached to the connecting members 13 and generally parallel to the first and second side plates 11, 16 so as to divide the document receiving space into a plurality of document holding rooms 150 which are accessible from the open top of the bag body 10.

When the cover plate 12 is removed to uncover the bag body 10, documents can be inserted separately into the document holding rooms 150 in accordance with identifying label tabs 14, thereby assisting in taking out of a selected document therefrom.

Note that each of the document holding rooms 150 has a V-shaped cross section so that when a stack of documents is inserted into a document holding room 150, the corners of documents may be folded, thereby causing damage thereto.

In order to avoid the aforementioned drawback, the partition sheets 15 are usually pulled outward away from the first side plate 11 during the insertion of documents into the document holding room 150. Frequent outward pulling of the partition sheets 15 can eventually disengage the same from the connecting members 13, thus leading the bag body 10 to ruin.

SUMMARY OF THE INVENTION

The main object of the present invention is to provide a document holder with an extensible-retractable bag so as to facilitate insertion of documents into the bag, thereby preventing damage to the documents.

The document holder of the present invention includes a first side plate, and a second side plate which has a horizontal support section that lies movably on a bottom plate of a bag body, and a vertical section that is formed integrally with the horizontal support section. The second side plate further has an inner peripheral portion that defines an opening which is formed through the vertical section and which is adjacent to the horizontal section, and a fastener that is installed on the inner peripheral portion. A vertical guideway plate projects integrally from the bottom plate in such a manner that the second side plate is located at a first position which is situated on the bottom plate between the guideway plate and the first side plate of the bag body. A vertical guide sheet is mounted on an inner surface of the guideway plate. A resilient pull strap interconnects the guide sheet and one of the first side plate and the bottom plate so as to pull the guideway plate toward the first side plate of the bag body.

The guideway plate can be unfolded relative to the bottom plate of the bag body upon removal of the cover plate from the top of the bag body so as to keep the guideway plate and the bottom plate in a plane. Under this condition the guide sheet is also brought into a horizontal position so as to guide the horizontal support section of the second side plate to move horizontally between the guide sheet and the guideway plate from the first position to a second position which is situated on the guideway plate and in which the fastener of the second side plate can be fastened to the guideway plate. Thus, the second side plate is prevented from being pulled back to the first position by the resilient pull strap. In this case, the partition sheets define a plurality of document holding rooms, each of which has a uniform width along the total height thereof.

Accordingly, documents can be easily inserted into the holding rooms without the risk of being folded and/or damaged.

BRIEF DESCRIPTION OF THE DRAWINGS

Other features and advantages of the present invention will become more apparent in the following detailed description of the preferred embodiment with reference to the accompanying drawings, in which.

DETAILED DESCRIPTION OF THE PREFERRED EMBODIMENT

Figure 1:
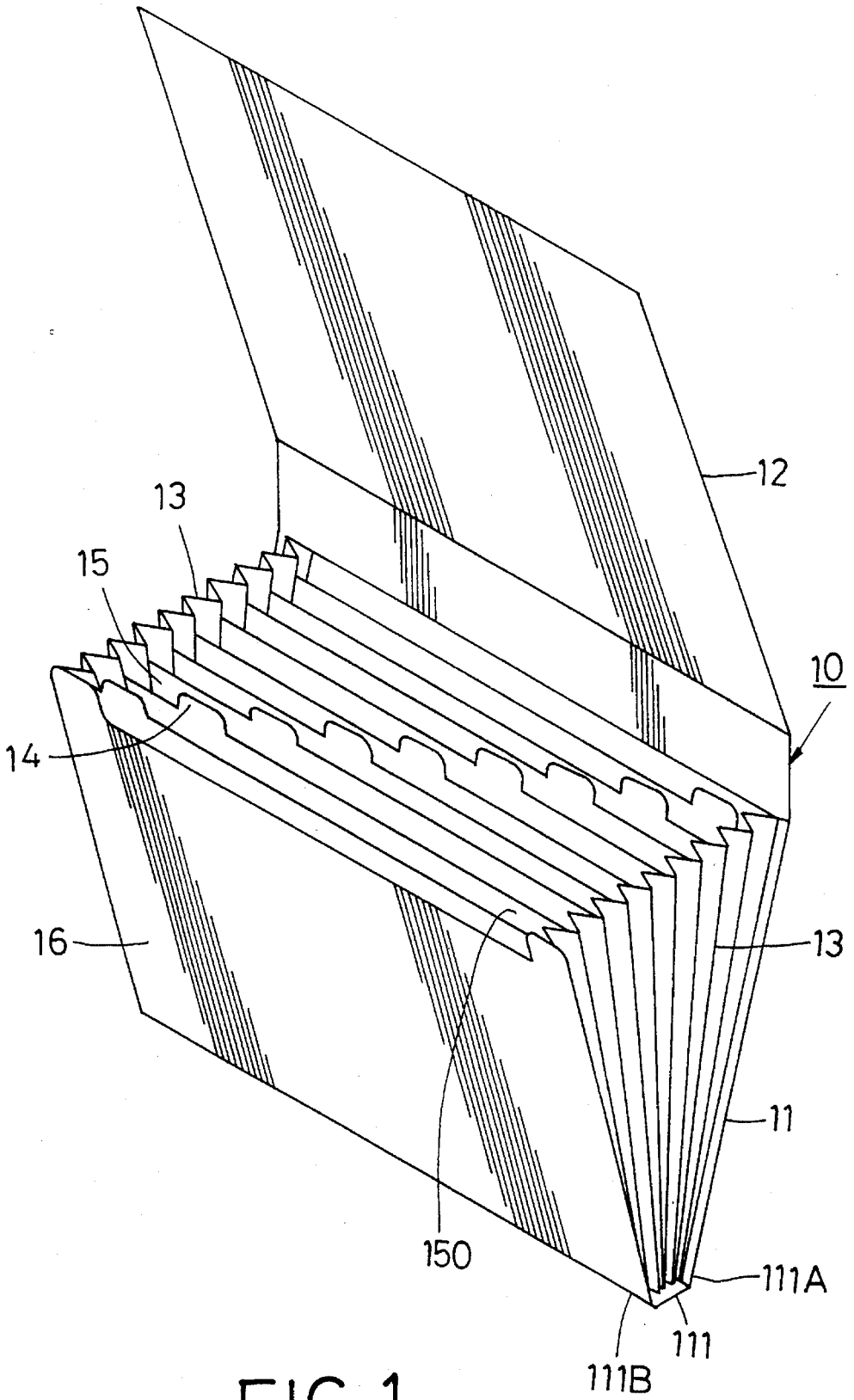
FIG. 1 PRIOR ART
FIG. 1 is a perspective view of a conventional document holder with a cover plate located at an open position.
Figure 2:
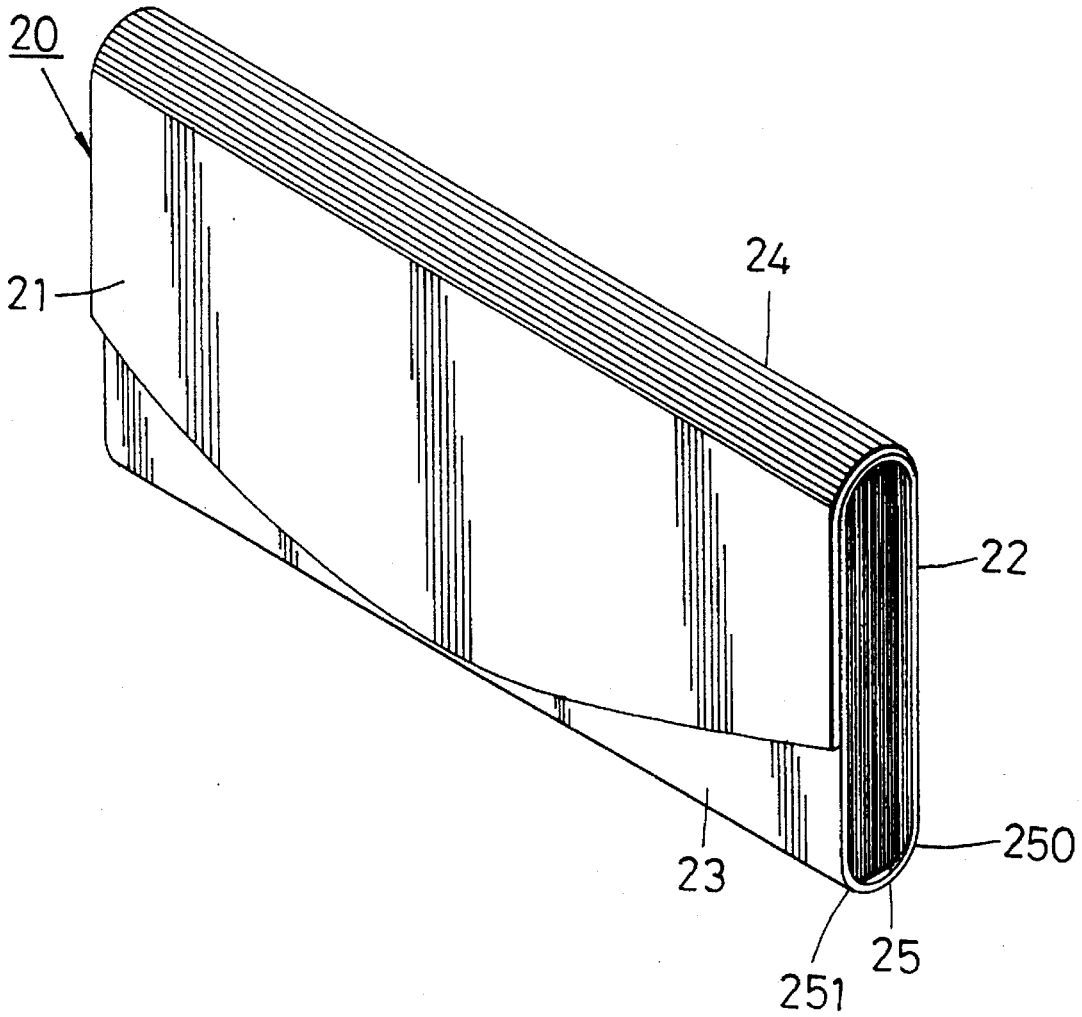
FIG. 2 is a perspective view of a document holder of the present invention.

Referring to FIG. 2, a document holder of the present invention includes a bag body 20 which is generally made from a plastic material.

Figure 3:
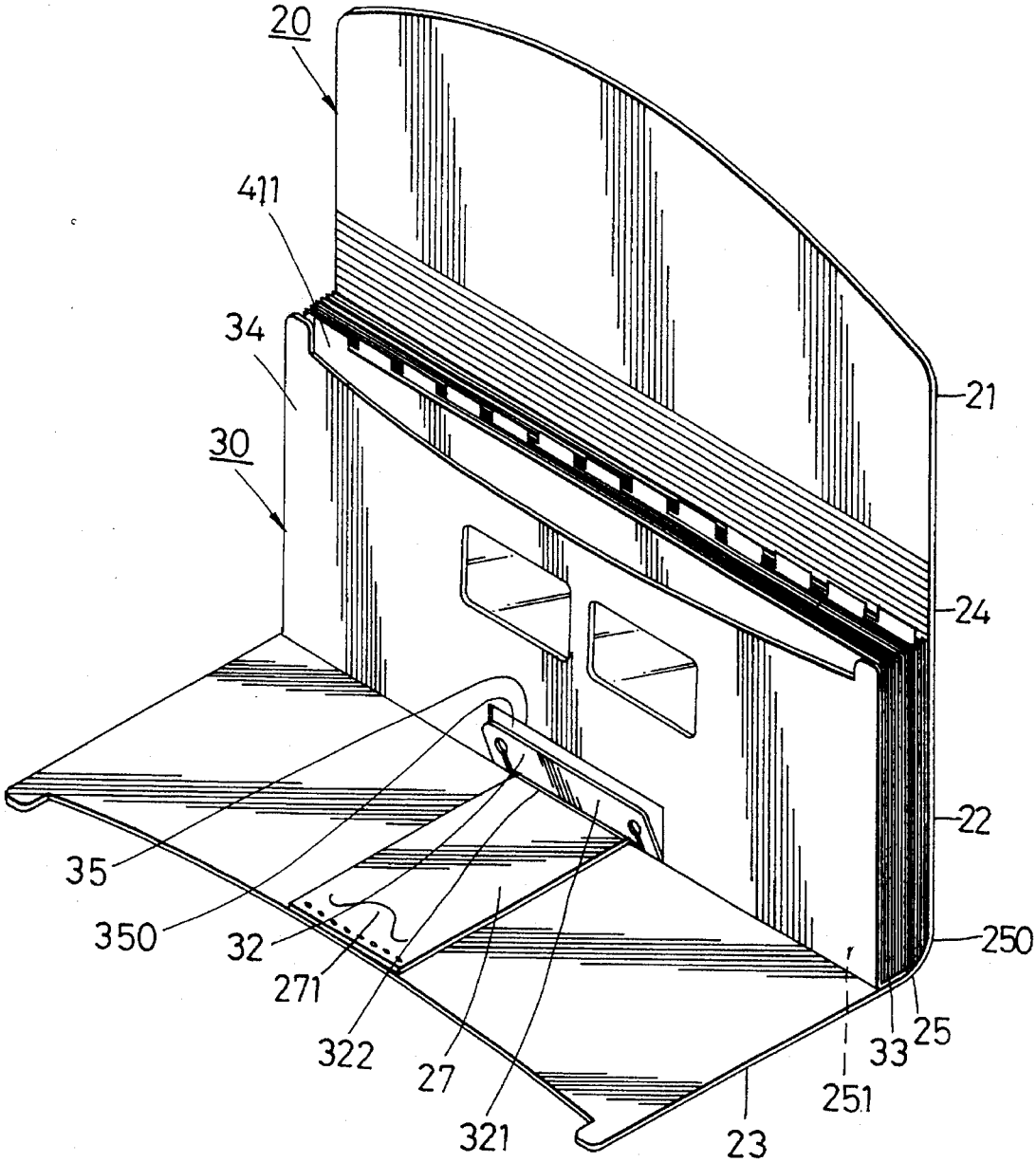
FIGS. 3 and 4 illustrate the unfolding operation of a document holder according to this invention.
Figure 4:
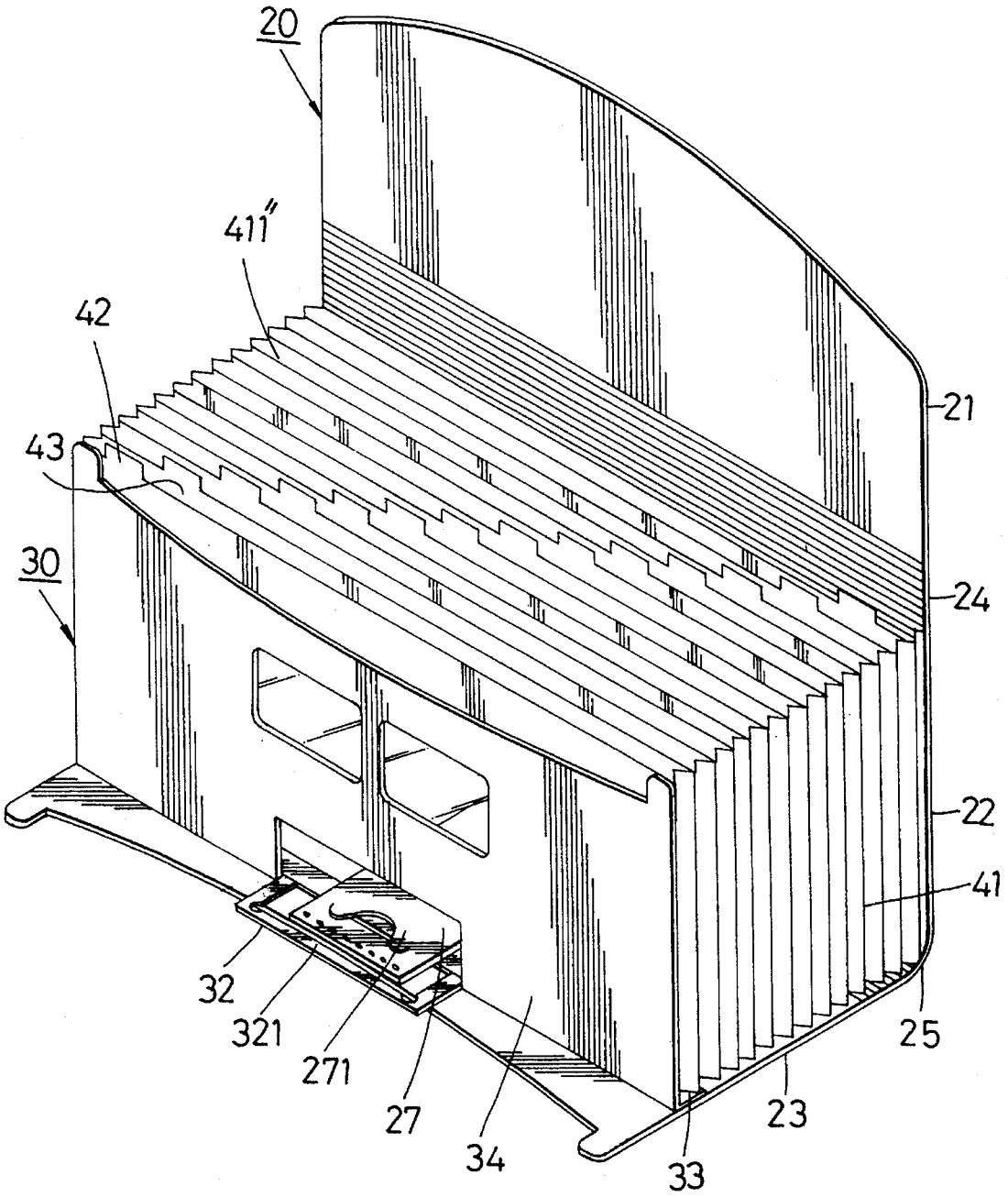

As illustrated in FIGS. 3 and 4, the bag body 20 includes an elongated and ribbed bottom plate 25 with a first long side 250 and a second long side 251 which is parallel to the first long side 250, a vertical first side plate 22 extending integrally from the first long side 250 of the bottom plate 25, a cover plate 21 extending integrally from an upper end portion of the first side plate 21 for covering the open top of the bag body 20, and a second side plate 30 of an L-shaped cross-section which has a horizontal support section 33 lying movably on the bottom plate 25, a vertical section 34 formed integrally with the horizontal support section 33, an inner peripheral portion 35 which defines an opening 350 formed through the vertical section 34 and located adjacent to the horizontal support section 33, and a fastener 32 installed on the inner peripheral portion 35. The cover plate 21 has an elongated and ribbed top plate portion 24 which is aligned vertically with the first side plate 22. The second side plate 30 is spaced apart from the first side plate 22. A pair of collapsible connecting members 41 interconnects the first and second side plates 22, 30 in such a manner that the second side plate 30 is generally parallel to the first side plate 22 and that a document receiving space is defined between the first and second side plates 22, 30 and between the connecting members 41. A plurality of partition sheets 43 are attached to the connecting members 41 and are provided with label tabs 42 in a known manner such that the sheets 43 are parallel with the first and second side plates 22, 30 and divide the document receiving space into a plurality of first document holding rooms 411 when in a normal position.

Note that the fastener 32 is made from a plastic material and has an elongated slot 322 formed therethrough, and a generally U-shaped split portion 321. The purpose of the split portion 321 will be explained in the following paragraphs.

The bag body 20 further includes a vertical guideway plate 23 which projects integrally from the second long side 251 of the bottom plate 25 (see FIG. 2), and a guide sheet 27 which extends through the slot 322 of the fastener 32 and which has an outer end portion heat-sealed on an inner surface of the guideway plate 23, and an inner end portion fastened to a resilient pull strap 26 that is fixed on the bottom plate 25. As illustrated in FIG. 2, the guideway plate 23 stands on the bottom plate 25 while the second side plate 30 is located at a first position which is situated on the bottom plate 25 between the guideway plate 23 and the first side plate 22. The guide sheet 27 is further provided with a generally U-shaped split portion 271 (see FIG. 3).

Figure 5:
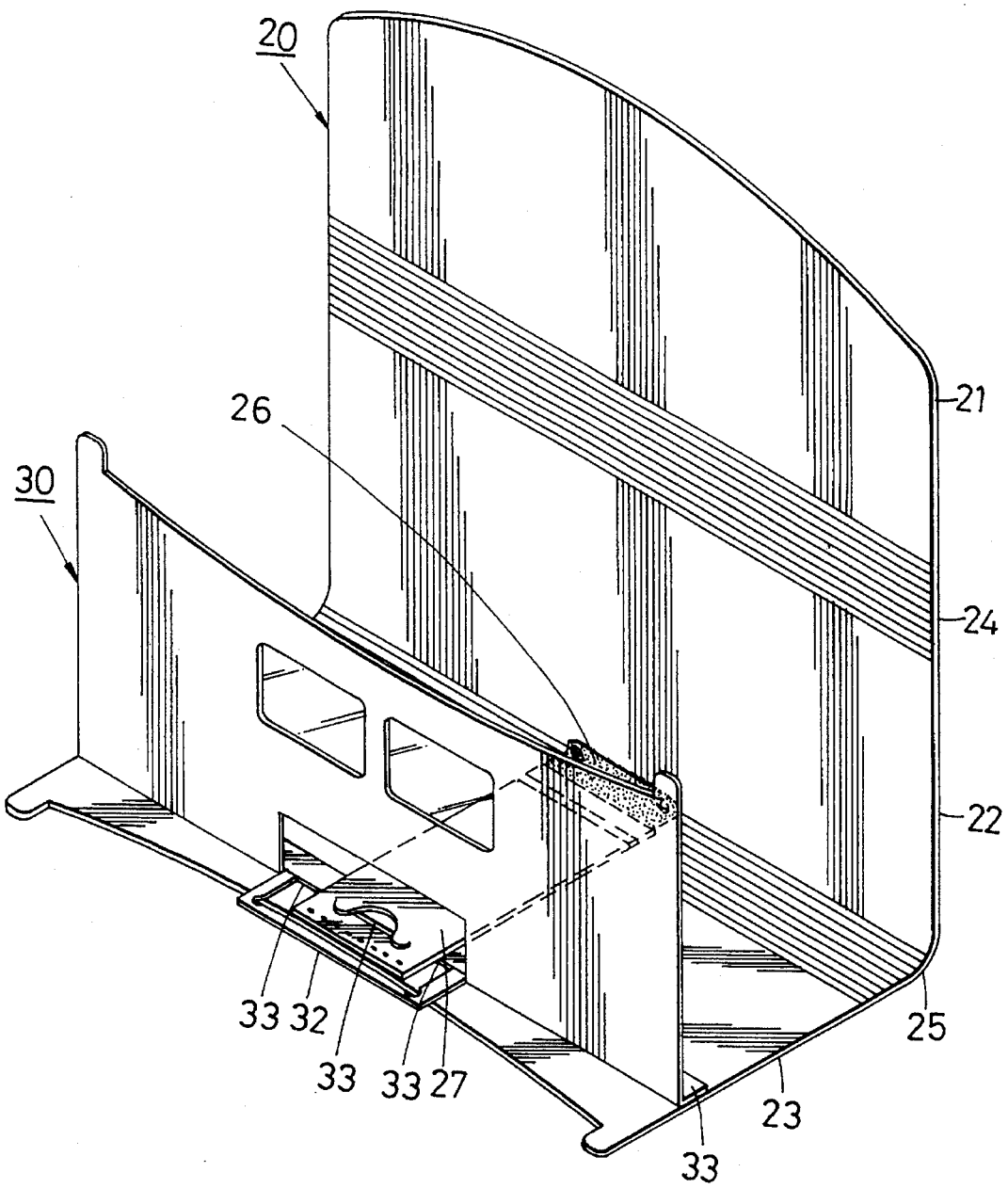
FIG. 5 is a view similar to FIG. 4, showing the document holder of the present invention when in a stretched position, wherein the connecting members and the partition sheets are removed.

Referring to FIGS. 3, 4 and 5, when the cover plate 21 is removed from the top of the bag body 20, the guideway plate 23 can be unfolded relative to the bottom plate 25 so as to keep the guideway plate 23 and the bottom plate 25 in a horizontal plane. Under this condition, the guide sheet 27 is brought into a horizontal position so that the horizontal support section 33 of the second side plate 30 can move between the guide sheet 27 and the guideway plate 23. The second side plate 30 can be pulled outward from a first position, as shown in FIG. 3, to a second position, as shown in FIG. 4, which is on the guideway plate 23. At this time, the collapsible connecting members 41 are unfolded and permit the partition sheets 43 to define a plurality of second document holding rooms 411" (see FIG. 4) which have a size greater than that of the first document holding rooms 411 shown in FIG. 3.

Figure 6:
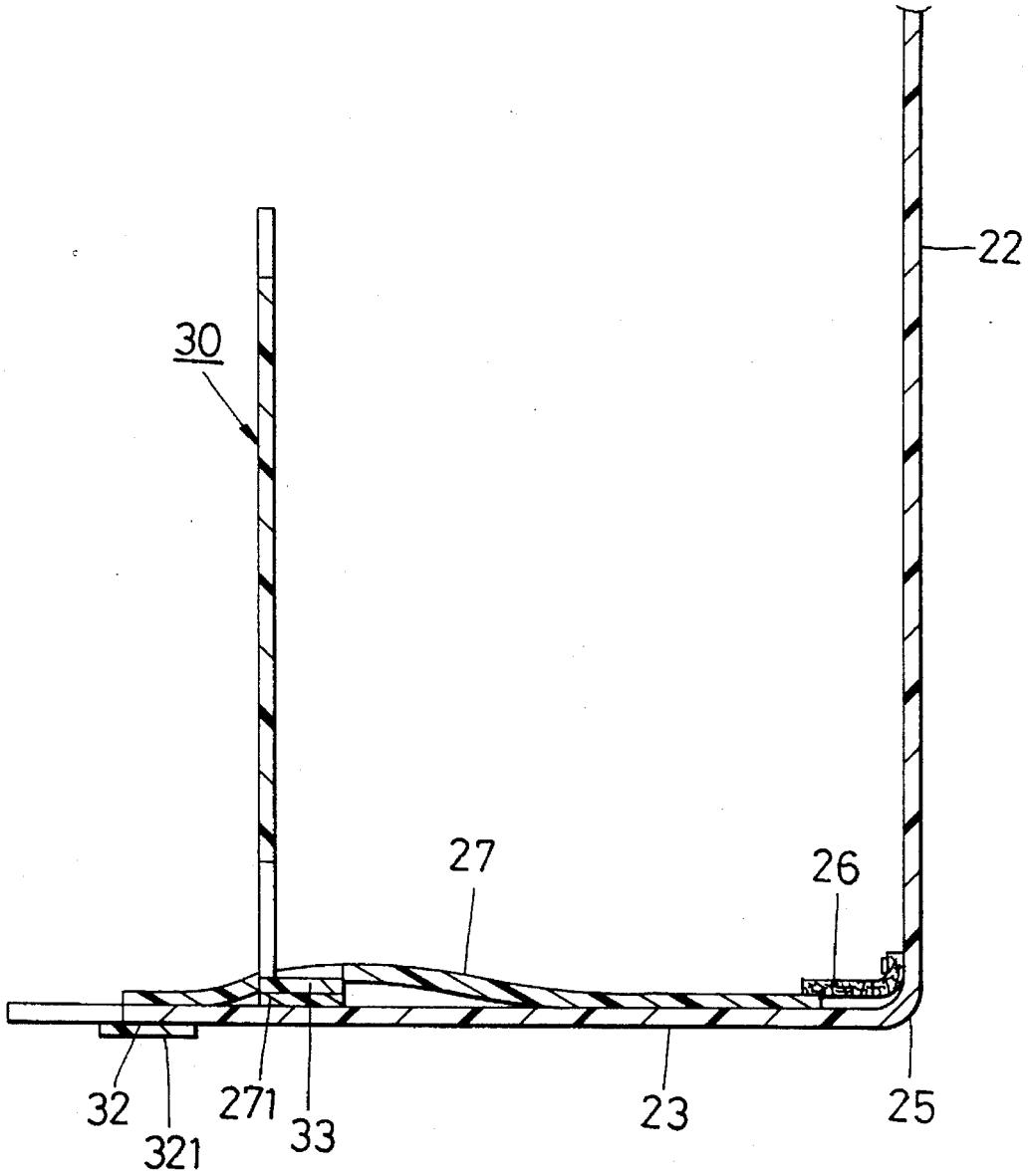
FIG. 6 is a sectional view illustrating how the second side plate of the document holder is retained on the guideway plate when located at the stretched position in accordance with this invention.

As shown in FIG. 6, when the second side plate 30 is at the second position, the split portion 321 of the fastener 32 can be turned downward and can be depressed to a level below the remaining portion of the fastener 32 so as to clamp tightly the guideway plate 23, thereby preventing the second side plate 30 from being pulled back to the first position by the resilient pull strap 26. The second side plate 30 is, therefore fixed at the second position.

Since each of the second document holding rooms 411" has a uniform width along the total height thereof, documents can be easily inserted into the room 411" without the risk of being folded and/or damaged.

Referring again to FIG. 6, before the second side plate 30 is moved outwardly away from the first side plate 22, the split portion 271 of the guide sheet 27 is depressed to a level below the remaining portion of the sheet 27 so that when contacting the juncture between the split portion 271 and the remaining portion of the guide sheet 27, the second side plate 30 cannot continue to move outwardly so as to prevent removal of the second side plate 30 from the guideway plate 23.

With the present invention thus explained, it is obvious to those skilled in the art that various modifications and variations can be made without departing from the scope and spirit thereof. It is therefore intended that the present invention be limited only as in the appended claims.

I claim:

1. A document holder including a bag body with an open top, said bag body having an elongated bottom plate with a first long side and a second long side parallel to said first long side, a vertical first side plate extending integrally from said first long side of said bottom plate, a cover plate extending integrally from an upper end portion of said first side plate and covering said open top, a vertical second side plate mounted on said bottom plate and spaced apart from said first side plate, a pair of collapsible connecting members mounted over said bottom plate and interconnecting said first and second side plates in such a manner that said second side plate is generally parallel to said first side plate and that a document receiving space is defined between said first and second side plates and between said connecting members, and a plurality of partition sheets attached to said connecting members and generally parallel to said first and second side plates so as to divide said document receiving space into a plurality of first document holding rooms accessible from said open top, wherein the improvement comprises:

said second side plate having a horizontal support section lying movably on said bottom plate and a vertical section formed integrally with said horizontal support section, an inner peripheral portion defining an opening through said vertical section and located adjacent to said horizontal support section, and a fastener installed on said inner peripheral portion;

said bag body including a vertical guideway plate projecting integrally from said second long side of said bottom plate in such a manner that said second side plate is located at a first position which is situated on said bottom plate between said guideway plate and said first side plate, an elongated vertical guide sheet mounted on an inner surface of said guideway plate, and a resilient pull strap interconnecting said guide sheet and one of said first side plate and said bottom plate so as to pull said guideway plate toward said first side plate, said guideway plate being unfoldable relative to said bottom plate when said cover plate is removed from said top of said bag body so as to keep said guideway plate and said bottom plate in a plane, and so as to permit outward movement of said second side plate from said first position to a second position which is situated on said guideway plate and in which said fastener of said second side plate can be fastened to said guideway plate in order to prevent said second side plate from being pulled back to said first position by said resilient pull strap and from outward movement from said second position;

said guide sheet being capable of being turned together with said guideway plate to a horizontal position so as to guide said horizontal support section of said second side plate to move horizontally between said guide sheet and said guideway plate from said first position to said second position, thereby unfolding said connecting members and permitting said plurality of partition sheets to define a plurality of second document holding rooms which have a size greater than that of said first document holding rooms.

2. The document holder as defined in claim 1, wherein said guide sheet has a generally U-shaped split portion which can clamp said horizontal support section of said second side plate, when said second side plate is located at said second position, so as to prevent outward movement of said second side plate from said second position.

3. The document holder as defined in claim 1, wherein said fastener is made from a plastic material and has an elongated slot formed therethrough through which said guide sheet extends for being fastened to said resilient pull strap, and a generally U-shaped split portion which can clamp tightly said guideway plate when said second side plate is located at said second position.

* * * * *